US005167051A

United States Patent [19]

Kousaka

[11] Patent Number: 5,167,051

[45] Date of Patent: Dec. 1, 1992

[54] CONTINUOUS FASTENER ELEMENT ROW FOR SLIDE FASTENERS

[75] Inventor: Yoshihiro Kousaka, Kurobe, Japan

[73] Assignee: Yoshida Kogyo K. K., Tokyo, Japan

[21] Appl. No.: 779,818

[22] Filed: Oct. 21, 1991

[30] Foreign Application Priority Data

Oct. 23, 1990 [JP] Japan ..... 2-284966

[51] Int. Cl.[5] ..... A44B 19/00

[52] U.S. Cl. ..... 24/391; 24/394; 24/406

[58] Field of Search ..... 24/391, 381, 394, 399, 24/400, 401, 404, 406

[56] References Cited

U.S. PATENT DOCUMENTS

| | | | |
|---|---|---|---|
| 2,018,099 | 10/1935 | Sundback | 24/391 |
| 2,637,886 | 5/1953 | Hora | 24/406 |
| 2,919,482 | 1/1960 | Casson . | |
| 3,047,923 | 8/1962 | Wilcken . | |
| 3,047,924 | 8/1962 | Wilcken . | |
| 3,057,030 | 10/1962 | Claus . | |
| 3,128,518 | 4/1964 | Steingbrubner . | |
| 3,199,162 | 8/1965 | Sohr et al. . | |
| 3,255,504 | 6/1966 | Porepp . | |
| 3,540,084 | 11/1970 | Frohlich . | |
| 3,609,827 | 10/1971 | Heimberger . | |
| 3,822,444 | 7/1974 | Johns . | |
| 3,855,672 | 12/1974 | Takamatsu | 24/394 |
| 4,989,300 | 2/1991 | Fukuroi | 24/391 |

FOREIGN PATENT DOCUMENTS

| | | | |
|---|---|---|---|
| 0506818 | 10/1954 | Canada | 24/406 |

*Primary Examiner*—Victor N. Sakran

*Attorney, Agent, or Firm*—Hill, Van Santen, Steadman & Simpson

[57] ABSTRACT

A continuous row of interlocking fastener elements made of a plastic monofilament is used on a slide fastener. The coupling head of each fastener element has in its front face at the middle a groove extending longitudinally of the fastener element row and also has, one on its each side, a pair of opposed arcuate protuberances merging with the bottom of the groove and protruding longitudinally of the fastener element row.

2 Claims, 2 Drawing Sheets

CONTINUOUS FASTENER ELEMENT ROW FOR SLIDE FASTENERS

BACKGROUND OF THE INVENTION

1. Field of the Invention

The present invention relates generally to a slide fastener, and more particularly to a continuous row of fastener elements of coiled or meander configuration made of a plastic monofilament and used for manufacture of slide fasteners.

2. Description of the Prior Art

Heretofore, some continuous fastener elements of the type described above have their whole coupling heads merely flattened by a suitable means such as stamping rollers and others have their whole coupling heads similarly flattened and furthermore have the thus flattened coupling heads convexed over their entire front faces.

When opposed fastener element rows of the conventional types pass through a Y-shaped guide channel of a slider for opening and closing a slide fastener, mating coupling heads of the opposed fastener element rows make surface-to-surface contact with each other within the Y-shaped guide channel of the slider, which contact causes the reciprocation of the slider sluggish. Furthermore, since the coupling heads are convexed over their entire front faces, the mating coupling heads of the opposed fastener element rows in face-to-face contact with each other within the slider are inclined to slip over their convex front faces and displace out of coupling alignment with each other, so that the fastener elements are unstable to carry out coupling and uncoupling operation.

SUMMARY OF THE INVENTION

With the foregoing difficulties in view, it is therefore an object of the present invention to provide a pair of continuous rows of interlocking fastener elements which carry out stable coupling and uncoupling operation and which enable a slider to reciprocate along themselves quick and smooth for opening and closing a slide fastener.

According to the present invention, there is provided a continuous row of interlocking fastener elements used on a slide fastener and made of a plastic monofilament, each fastener element including a coupling head, a pair of upper and lower legs extending rearwardly from the coupling head, and a connecting portion disposed remote from the coupling head and extending between one of said legs and a leg of an adjacent fastener element, the coupling head having in its front face at the middle a groove extending longitudinally of the fastener element row and also having, on its each side, a pair of opposed arcuate protuberances merging with the bottom of the groove and protruding longitudinally of the fastener element row.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
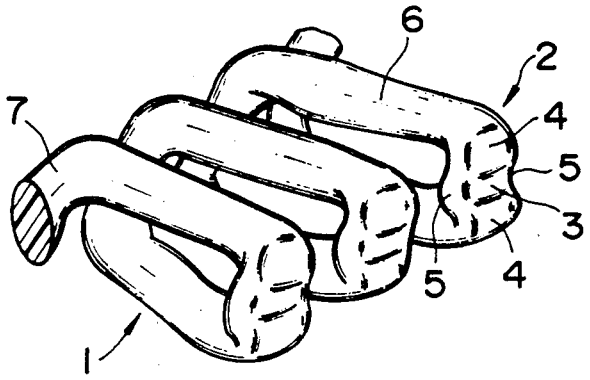
FIG. 1 is a fragmentary perspective view of a continuous row of coiled fastener elements shown as a preferred embodiment of the present invention.

FIG. 1 shows part of a continuous row of coiled fastener elements in which the present invention is embodied. These coiled fastener elements 1 are made of a monofilament of thermoplastic resins such as polyamide, polyester etc. Each fastener element 1 comprises a coupling head 2, a pair of upper and lower legs 6 extending rearwardly from the coupling head 2 and a connecting portion 7 disposed remote from the coupling head 2 and extending between one of said legs 6 and a leg 6 of an adjacent fastener element 1. The coupling head 2 is formed into a configuration closely described below by suitable means such as stamping rollers and is adapted for coupling engagement with mating coupling heads of the opposite fastener element row.

As better shown in FIG. 1, the coupling head 2 has in its front face at the middle a groove 3 extending longitudinally of the fastener element row and a pair of convexes 4 disposed on the opposite sides of the groove 3. The coupling head 2 has a pair of opposed arcuate protuberances 5 one on each side thereof which merge with the bottom of the groove 3 and protrude longitudinally of the fastener element row.

Figure 3:
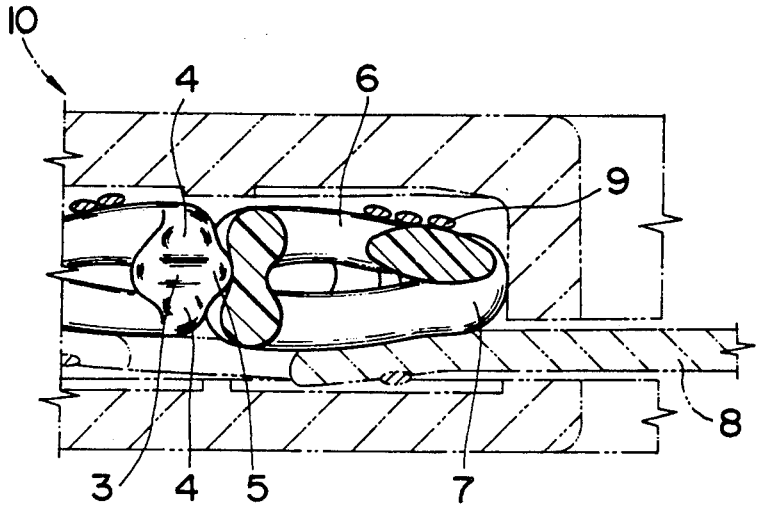
FIG. 3 is a cross-sectional view taken on line III—III of FIG. 2.

As shown in FIG. 3, the coupling element row of the contruction described above is sewn to one longitudinal edge of a fastener tape 8 by a sewing thread 9 running alongside of the connecting portions 7.

Figure 2:
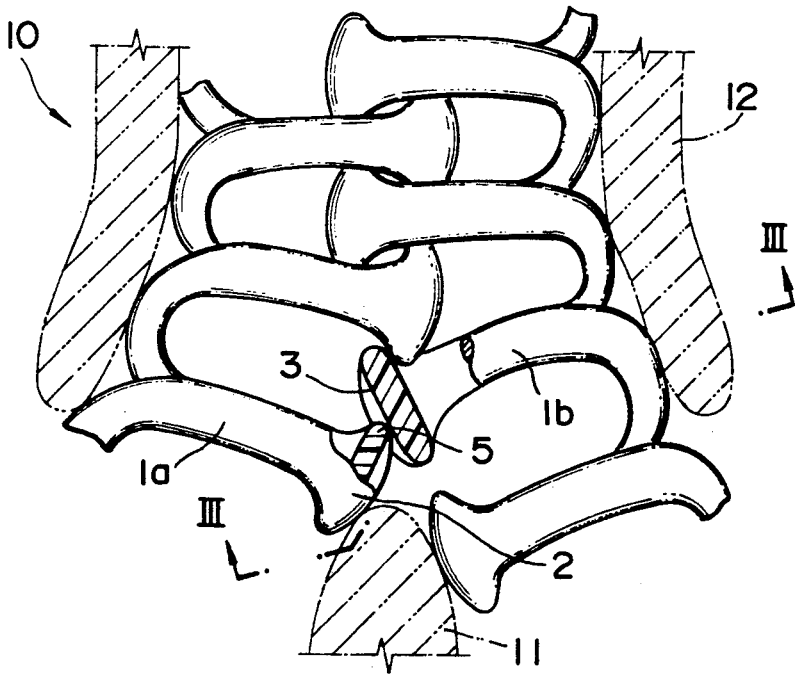
FIG. 2 is a fragmentary front view of opposed rows of coiled fastener elements of FIG. 1, shown in coupled disposition within a slider.

With the construction of the fastener elements 1 as described above, the fastener elements 1 operate as follows, when the opposed fastener element rows are coupled with each other by the slider 10. As better shown in FIG. 2, as the slider 10 is pulled downwards, as viewed in FIG. 2, the opposed fastener element rows are smoothly guided into coupling engagement with each other by opposed flanges 12, 12 of the slider 10. Specifically, as shown in FIGS. 2 and 3, a coupling head 2 of a certain fastener element 1*a* on one fastener element row has its one arcuate protuberance 5 first come into fitting engagement with the groove 3 of the mating fastener element 1*b* on the opposite fastener element row. Continued pull of the slider 10 will cause the lowermost fastener element 1*a* of said one fastener element row come into full coupling engagement with the mating fastener element 1*b* of said opposite fastener element row, with the arcuate protuberance 5 of the former smoothly guided by and along the groove 3 of the latter. With such guidance of the arcuate protuberance 5 by the groove 3, the fastener elements 1 are well prevented from twisting and displacing relative to each other.

With the pair of convexes 4, 4 on the opposite sides of the groove 3, even if the arcuate protuberance 5 of the fastener element 2 deviates from the groove 3 of the mating fastener element, thus contacting either of the convexes 4, the arcuate protuberance 5 is guided smoothly over either of the convexes 4 into fitting engagement with the groove 5. This construction is more advantageous with coiled fastener elements without a filler core inserted therethrough which are susceptible of unstable movement while passing through the slider 10.

The above-mentioned protuberance-groove engagement helps to make the total widths of the coupled element rows slightly less by depth of the groove 3. Furthermore, the protuberance-groove-engagement helps to decrease the contact area of the coupling heads 2 of the mating fastener elements 1 and hence frictional resistance therebetween. The decrease of the total widths of the coupled fastener element rows and the decrease of frictional resistance between the coupling heads are advantageously combined to cause the reciprocation of the slider 10 along the fastener element rows very smooth, whether in opening direction or in closing direction.

Figure 4:
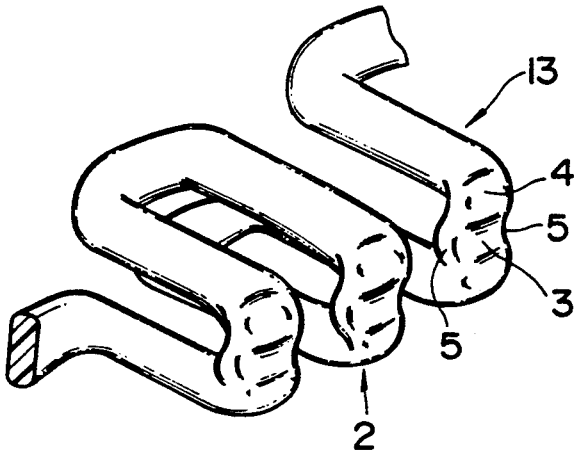
FIG. 4 is a view similar to FIG. 1 but shows a continuous row of meander fastener elements as a modified embodiment of the present invention.

FIG. 4 shows another embodiment of the present invention wherein the invention is embodied in a continuous row of meander or zigzag fastener elements 13, instead of the continuous row of coiled fastener elements 1 in the preceding embodiment. Since this embodiment is much the same as the preceding embodiment except for the configuration of the fastener elements 1 being meander, any further description is omitted.

Although the continuous fastener element rows according to the present invention are coupled or decoupled with each other sufficiently stably and reliably whether with or without a filling core inserted therethrough, the continuous fastener element rows are the more stable and reliable to couple and decouple with each other with a filling core inserted therethrough.

With the construction described above, the opposed fastener element rows are smoothly coupled or decoupled with each other without any torsion and displacement, so that the slide fastener is opened or closed very smoothly, quickly and reliably. And, the thus closed slide fastener will never become subject to fracture.

Furthermore, even if one fastener element row swerves from the other fastener element row, the swerving element row is readily rectified by the convexes 4. Therefore, the opposed fastener element rows are coupled by far more smoothly and reliably.

Obviously, various modifications and variations of the present invention are possible in the light of the above teaching. It is therefore to be understood that within the scope of the appended claims the invention may be practiced otherwise than as specifically described.

What is claimed is:

1. A continuous row of interlocking fastener elements used on a slide fastener and made of a plastic monofilament, each fastener element including a coupling head, a pair of upper and lower legs extending rearwardly from the coupling head, and a connecting portion disposed remote from the coupling head and extending between one of said legs and a leg of an adjacent fastener element, the coupling head having in its front face at the middle a groove extending longitudinally of the fastener element row and also having, one on its each side, a pair of opposed arcuate protuberances merging with the bottom of the groove and protruding longitudinally of the fastener element row.

2. A continuous row of interlocking fastener elements according to claim 1, the coupling head further including a pair of convexes on the opposite sides of the groove.

* * * * *